US007990245B1

(12) United States Patent
Krichtafovitch

(10) Patent No.: US 7,990,245 B1
(45) Date of Patent: Aug. 2, 2011

(54) MULTI-SECTIONAL BOBBIN FOR HIGH VOLTAGE INDUCTOR OR TRANSFORMER

(75) Inventor: Igor Krichtafovitch, Kirkland, WA (US)

(73) Assignee: Tessera, Inc., San Jose, CA (US)

( * ) Notice: Subject to any disclaimer, the term of this patent is extended or adjusted under 35 U.S.C. 154(b) by 0 days.

(21) Appl. No.: 12/765,548

(22) Filed: Apr. 22, 2010

(51) Int. Cl.
*H01F 27/30* (2006.01)

(52) U.S. Cl. ..... 336/198

(58) Field of Classification Search ..... 336/65, 336/185, 198, 206
See application file for complete search history.

(56) References Cited

U.S. PATENT DOCUMENTS 3,635,007 A 1/1972 Yoshida et al.
4,274,136 A 6/1981 Onodera et al.
4,352,079 A 9/1982 Mueller et al.
4,862,130 A * 8/1989 Ellison ..... 336/185
5,332,989 A 7/1994 Ching
5,523,734 A * 6/1996 Beck et al. ..... 336/185

OTHER PUBLICATIONS

Casmero et al., "Transformer Bobbin and Core Selection Involves Interdisciplinary Design and Cost Issues," PCIM, www.pcim.com, Oct. 2000, pp. 1-6.

* cited by examiner

*Primary Examiner* — Tuyen Nguyen
(74) *Attorney, Agent, or Firm* — Zagorin O'Brien Graham LLP

(57) ABSTRACT

Improved multi-sectional bobbin designs described herein define a channel suitable to accommodate a portion of the wire that transits from prior winding section to the next, wherein opposing walls of the channel so defined separate the transiting portion of the wire from both prior and next winding sections through a substantial entirety of the wires descent from an upper winding layer in the prior section to a lower winding layer in the next.

18 Claims, 7 Drawing Sheets

MULTI-SECTIONAL BOBBIN FOR HIGH VOLTAGE INDUCTOR OR TRANSFORMER

BACKGROUND

1. Field of the Invention

The present application relates to spindles or winding forms often referred to as "bobbins" that are suitable for winding wire to form an inductor, and more particularly, to multi-sectional bobbin designs and related assemblies suitable for high-voltage electronics.

2. Description of the Related Art

At the heart of most inductors and transformers is a bobbin that serves as a winding form. Typically, the bobbin supports winding of wire, facilitates alignment of such windings with the core(s) and, in some cases, provides termination or connection points. High voltage bobbins are often multi-sectional in design and, relative to a high voltage coil, winding around a prior section is typically completed before the wire transfers to a next section. Multi-sectional designs are typically employed to separate portions of the wound wire in which greatly disparate potentials are induced. In this way, the possibility of electrical breakdown can be reduced or at least managed.

Conventionally in multi-sectional bobbin designs, as the wound wire transits from a prior section to the next, it transfers from the top of a prior section (now fully wound) to the bottom of the next. This next section is then wound to its top and, depending on the number of sections provided, the process repeats. Unfortunately, in conventional multi-section bobbin and inductor designs the descending portion of wire that transfers from top of the prior section to bottom of the next is proximate to at least the adjacent coils of the layers of wire wound in this next section. Absent additional insulation, the thin layer of insulation that encapsulates the transformer (or inductor) wire may be insufficient to resist electrical breakdown. Accordingly, in conventional multi-sectional bobbin designs, an additional insulative layer such as Kapton® tape or the like, may be applied to the descending portion of wire to isolate it from the layers of wire wound in this next section. While generally effective, such an arrangement tends to interfere with mass production using conventional techniques and equipment to automatically wind the bobbin.

Improved designs are desired.

SUMMARY

It has been discovered that improved multi-sectional bobbin designs may define a channel suitable to accommodate a portion of the wire that transits from prior winding section to the next, wherein opposing walls of the channel so defined separate the transiting portion of the wire from both prior and next winding sections through a substantial entirety of the wires descent from an upper winding layer in the prior section to a lower winding layer in the next.

In some embodiments in accordance with the present invention, a bobbin suitable for winding wire and thereby defining an inductor includes first and second winding sections separated from one another with an insulating barrier. The insulating barrier defines a channel suitable to accommodate a portion of the wire that transits from the first winding section to the second. The channel is defined by opposing walls configured to separate the transiting portion of the wire from both first and second winding sections through a substantial entirety of its descent from an upper winding layer in the first winding section to a lower winding layer in the second winding section.

In some embodiments, the bobbin further includes a wire retainer from which the wire, when wound, descends toward the second winding section. The wire retainer is proximate an entrance to the channel from the first winding section. In some embodiments, the wire retainer includes a pin, flange or other protuberance suitable for retaining the wire. In some embodiments, the wire retainer is positioned at a height off a winding surface of the first winding section that approximates a design height for the upper winding layer when wound therein. In some embodiments, the wire retainer is positioned at a height off a winding surface selected to prevent slippage of the retained wire downward along a first winding section-facing surface of the insulating barrier and proximate to lower winding layers when wound therein.

In some embodiments, the bobbin includes an alternative descend management structure, such as a ramp or ledge defined within the channel and descending from a height at or near the channel entrance whereby the transiting wire is supported at the channel entrance at a height that prevents slippage of the wire downward along a first winding section-facing surface of the insulating barrier.

In some embodiments, the insulating barrier circumferentially spans winding surfaces of the bobbin and overlapping extents thereof at least partially define the channel. In some embodiments, the circumferential extent of the insulating barrier is sufficient to insulate and isolate the descending portion of the wire from the first winding section and the second winding section throughout the substantial entirety of its descent.

In some embodiments, the configuration further includes the wire itself wound about the first section, descending through the channel from an upper winding layer wound about the first section to a lower winding layer wound about the second section, and further wound about the second section.

In some embodiments, the bobbin includes at least a third winding section, wherein the second and third winding sections are separated from one another with a second insulating barrier. In some embodiments, the second insulating barrier defines a second channel suitable to accommodate a portion of the wire that transits from the second winding section to the third, the second channel defined by opposing walls thereof configured to separate the transiting portion of the wire from both first and second winding sections through a substantial entirety of its descent from an upper winding layer in the second winding section to a lower winding layer in the third winding section.

In some embodiments in accordance with the present invention, a method of making a multi-sectional transformer coil includes providing a bobbin having first and second winding sections separated from one another with an insulating barrier, winding a first wire about the first section of the bobbin, guiding the first wire through a channel in the insulating barrier and thereby descending from an upper winding layer in the first winding section to a lower winding layer in the second winding section, and winding the first wire about the second section of the bobbin. The channel is defined by opposing walls configured to separate the descending portion of the first wire from both first and second winding sections through a substantial entirety of its descent from the upper winding layer in the first winding section to the lower winding layer in the second winding section.

In some embodiments, the method further includes forming the bobbin with the channel defined in the insulating barrier between first and second winding sections. In some embodiments, the method further includes forming proximate an entrance to the channel from the first winding section, a wire retainer from which the first wire, when wound, descends toward the second winding section and guiding the first wire to engage the wire retainer.

In some embodiments, the method further includes, prior to said winding of the first wire about the first and second sections of the bobbin, winding second wire about the bobbin to define a low turn count, primary coil wound through each of the winding sections and overlaying the low turn count, primary coil with insulative material. The winding of the first wire defines a closely-laterally-packed, layer-upon-layer winding through first and third winding sections overlaying the insulative material and the primary coil concentrically formed thereunder.

In some embodiments, the method further includes magnetically coupling with an adjacent coil with the coil defined by the first wire wound about the first and second winding sections.

In some embodiments in accordance with the present invention, a transformer includes magnetically coupled first and second coils, wherein the second coil is wound about a multi-sectional bobbin including first and second winding sections separated from one another with an insulating barrier that defines a channel to accommodate a portion of the wire that transits from the first winding section to the second winding section, the channel defined by opposing walls configured to separate the transiting portion of the wire from both first and second winding sections through a substantial entirety of its descent from an upper winding layer in the first winding section to a lower winding layer in the second winding section. In some embodiments, the transformer is configured such that the first and second coils constitute primary and secondary coils, respectively, in a step-up configuration.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE EMBODIMENTS

Inductors, coils and transformers are widely used in electric designs and systems. Typically, wire or some other conductor is wound around a spindle or winding form, hereinafter referred to as a "bobbin" in order to impart desired structure to the windings and, often, to facilitate alignment of such windings with a core. Persons of ordinary skill in the art will appreciate a wide variety of bobbin configurations, geometries, material selections, conductors, core configurations, etc. and this description does not attempt to inventory the substantial diversity of such variations. Instead, in the interests of conciseness and specificity with respect to certain inventive aspects, the present description focuses on exemplary embodiments in which a circular multi-sectional bobbin is wound (or windable) with wire in configurations typical (or at least illustrative) of coils employed in compact, small-form factor, high-voltage transformers. Based on that description context, persons of ordinary skill in the art will appreciate extensions, adaptations and exploitations of the inventive techniques for (or in) other designs, configurations, etc.

A variety of scales, repeats, geometries and other design variations are envisioned for structures described herein, together with variations in positional interrelationships thereamongst. Nonetheless, for concreteness, this description emphasizes certain illustrative embodiments. For example, in much of the description herein, a centimeter-scale, three-section, circular bobbin is illustrated and described relative to windings that may be generally suited for use in a secondary coil of a high-voltage, step-up transformer for electrical subsystems such as a power supply for an electrohydrodynamic (EHD) fluid accelerator. Of course, other scales, profiles and exploitations are possible and envisioned. Accordingly, in view of the above and without limitation, certain illustrative multi-sectional bobbins are now described.

Illustrative Three-Section, Circular Bobbin Design

Figure 1:
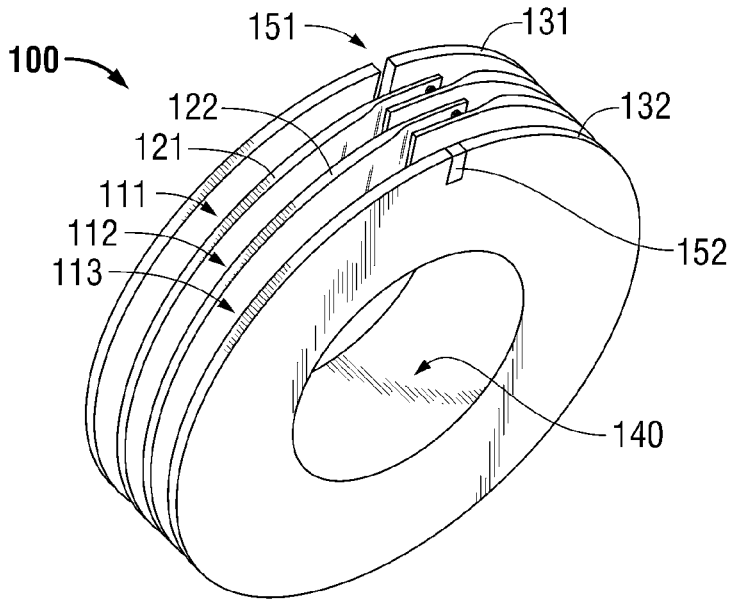
FIG. 1 is a perspective view of a multi-sectional bobbin in accord with some embodiments of the present invention.

FIG. 1 is a perspective view of a multi-sectional bobbin 100 in accord with some embodiments of the present invention. Three winding sections 111, 112, 113 are separated by respective insulating barriers 121, 122 that substantially insulate and isolate a portion of wire wound about a particular winding section from that wound about an adjacent winding section. For example, insulating barrier 121 insulate and isolate the portion of wire wound about the first winding section 111 from that wound about the second winding section 112. Likewise, insulating barrier 122 insulate and isolate the portion of wire wound about the first winding section 112 from that wound about the third winding section 113. Persons of ordinary skill in the art will appreciate extensions to larger numbers of wiring sections.

Outer insulating barriers 131, 132 likewise insulate and isolate respective windings (here, first section 111 windings and third section 113 windings) from circuits or structures that may be positioned adjacent to a wound bobbin when current flows or is induced in windings thereof. To accommodate entry of the wire into the first winding section 111 and exit of the wire from the third winding section 113, notches 151 and 152 are provided in the respective outer insulating barriers. Although terminations are not specifically illustrated, persons of ordinary skill in the art will recognize that for certain applications it may be desirable to include termination points or binding posts. Entry and exit notches as well as terminations, if provided, may be adapted to design constraints or to facilitate automated fabrication or bonding.

In the illustrated configuration, multi-sectional bobbin 100 is round (and may accommodate (within circular void 140) a cylindrical core (not shown) or a core with a round central leg (such as the modified E core later illustrated). In general, multi-sectional bobbin 100 may be formed of any of a variety of non-flammable insulative materials including numerous thermoplastic and thermoset materials commonly employed in the art. Often, dielectric strength, UL flammability, temperature classification, mechanical strength or stiffness and/or thermal expansion characteristics will dictate selection; however, in general, material selection is a matter of design choice. In some embodiments, an amorphous thermoplastic polyetherimide (PEI) marketed by GE Plastics under the trade name ULTEM® may be injection molded to form multi-sectional bobbin structures such as illustrated and described herein.

Figure 2A:
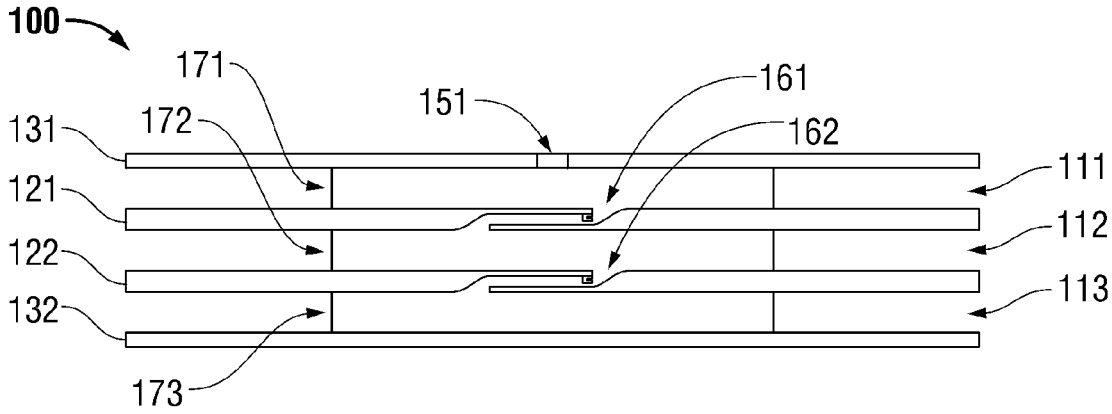
FIGS. 2A and 2B are respective top and side views of a multi-sectional bobbin generally in accord with that illustrated in FIG. 1.
Figure 2B:
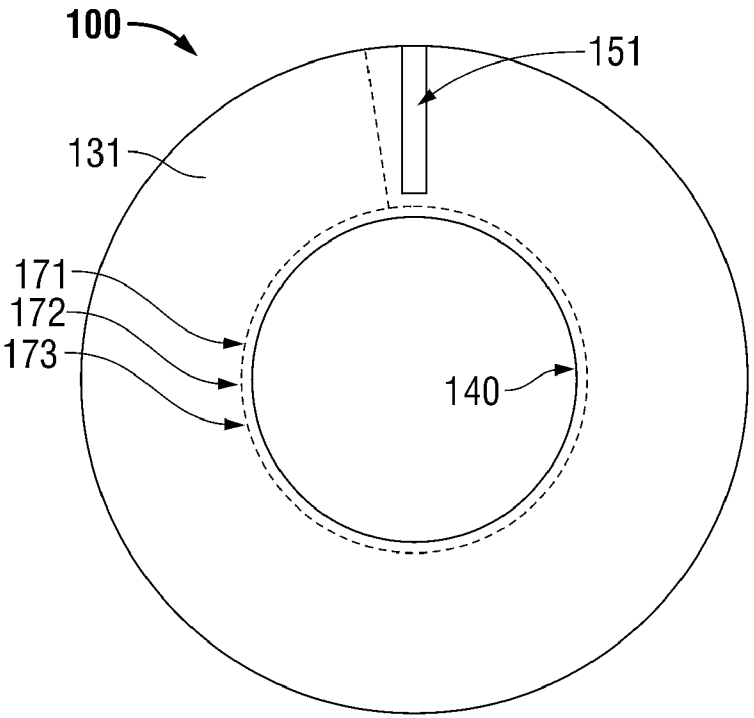

FIGS. 2A and 2B are respective top and side views of a multi-sectional bobbin generally in accord with that illustrated in FIG. 1. FIG. 2A presents a top view that reveals the cylindrical winding surfaces 171, 172, 173 upon which wire may be wound within each of the respective winding sections 111, 112, and 113. FIG. 2A likewise reveals channels 161 and 162 defined through respective insulating barriers 121 and 122 to allow the wire (once wound about a particular winding section) to transit from an upper winding layer of a prior winding section to a lower winding layer of a next winding section. Thus, upon completion of first section 111 windings up from winding surface 171 to an uppermost layer thereof, wire (not specifically shown in FIG. 2A) may transit through channel 161, descending toward winding surface 172 to begin windings about the second winding section 112. Upon completion of second section 112 windings up from winding surface 172 to an uppermost layer thereof, the wire may next transit through channel 162, descending toward winding surface 173 to begin windings about the third winding section 113. Although two channels between respective ones of the three winding sections are provided in the illustrated configuration, persons of ordinary skill in the art will recognize that additional winding sections together with additional corresponding channels through additional insulating barriers may be provided if desired.

FIG. 2C illustrates, in side view, certain features and alignments of multi-sectional bobbin 100 in accord with the previously described drawings. In particular, FIG. 2C illustrates alignment and curvature of winding surfaces 171, 172 and 173 about a rotational axis of multi-sectional bobbin 100.

Figure 3A:
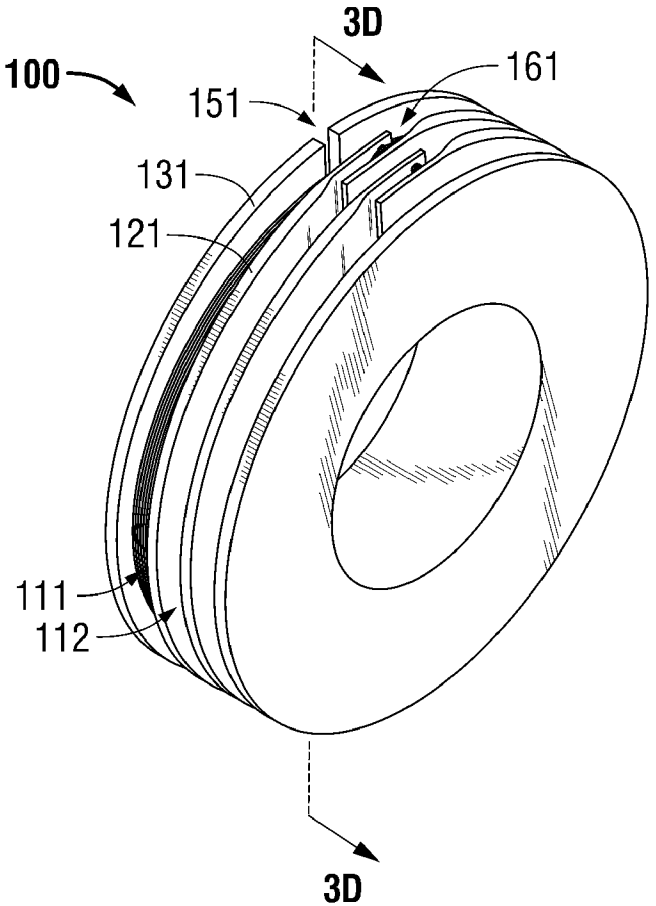
FIG. 3A is a perspective view of FIG. 1 augmented to illustrate the multi-sectional bobbin partially-wound with wire around a first winding section thereof.
Figure 3B:
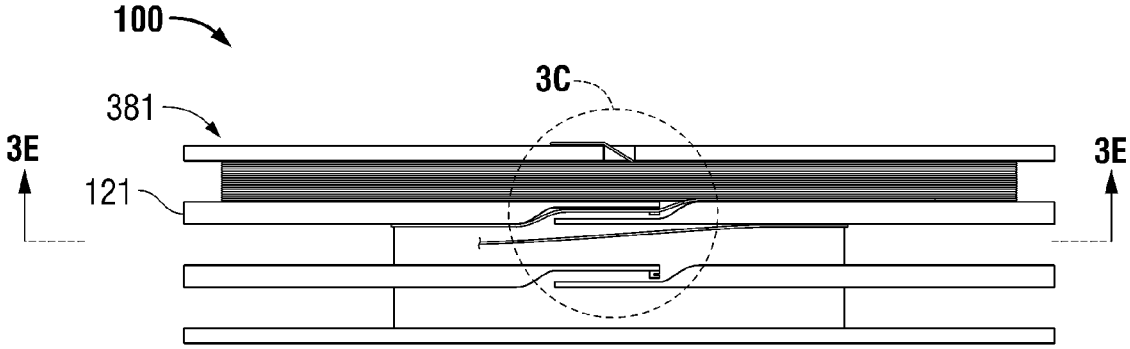
FIGS. 3B, 3C, 3D and 3E illustrate corresponding top and cross-sectional views in which descent of an illustrated portion of the wire through a channel from an upper wiring layer of the first winding section of the multi-sectional bobbin to a lower wiring layer of a second section is apparent.

FIGS. 3A and 3B offer views in correspondence with those of FIGS. 1 and 2A, but augmented to illustrate multi-sectional bobbin 100 partially-wound with wire around first winding section (111) thereof. After entering through notch 151, the illustrated wire (301) is wound about first winding section 111 from a lower winding level (obscured from view, but recall winding surface 171, FIGS. 2A and 2B) to an uppermost layer 381 thereof. In general, the illustrated winding from a lower winding level in a given winding section to the uppermost layer thereof is laid down in a closely-laterally-packed, layer-at-a-time manner in accord with inductive coupling goals of a secondary coil configuration for a step-up high-voltage transformer.

From the uppermost layer 381 in first winding section 111, wire 301 transits the channel 161 defined through tapered, but laterally-overlapping portions of insulating barrier 121. In the illustration of FIG. 3, a wire retainer 382 is provided proximate to a first winding section-facing entrance to channel 161. Wire retainer 382 retains a channel entering portion of wire 301 at a height (e.g., a winding radius in the illustrated circular bobbin) generally corresponding to the uppermost layer 381 wound about first winding section 111. Preferably, wire retainer 382 is positioned at or even slightly above an expected maximal height of uppermost layer 381, though more generally, any position that substantially prevents the entering portion of wire 301 from slipping down the first winding section-facing side of insulating barrier 121 may be suitable. FIG. 3B (and more particularly cross-sectional views of FIGS. 3C and 3D) illustrate descent of wire 301 through channel 161 to begin (e.g., at winding surface 172) a lower winding level of second winding section 112.

Figure 3C:
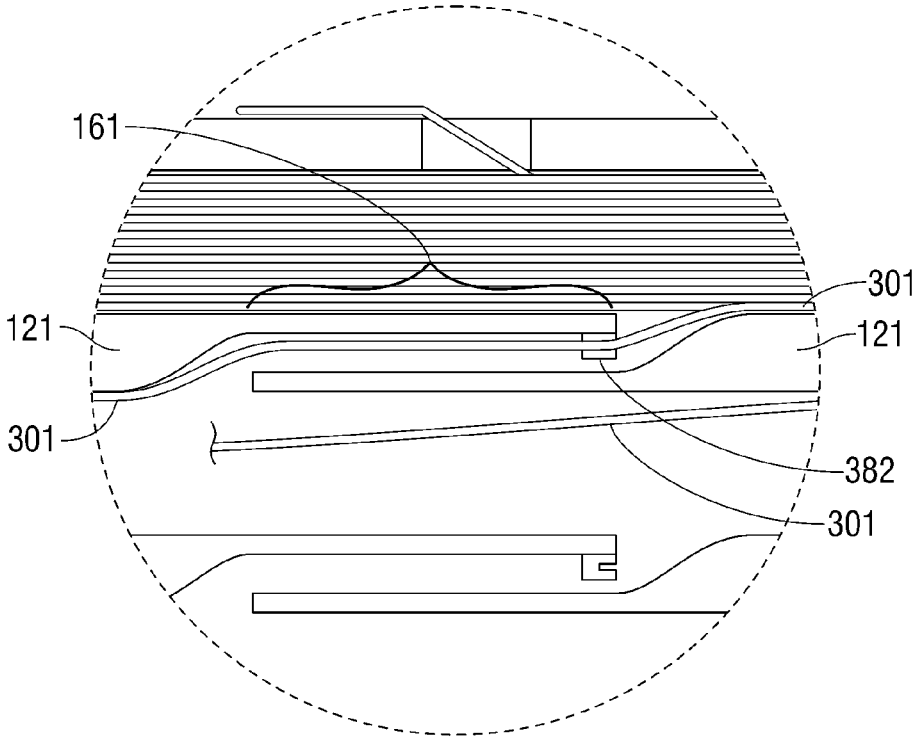
Figure 3E:
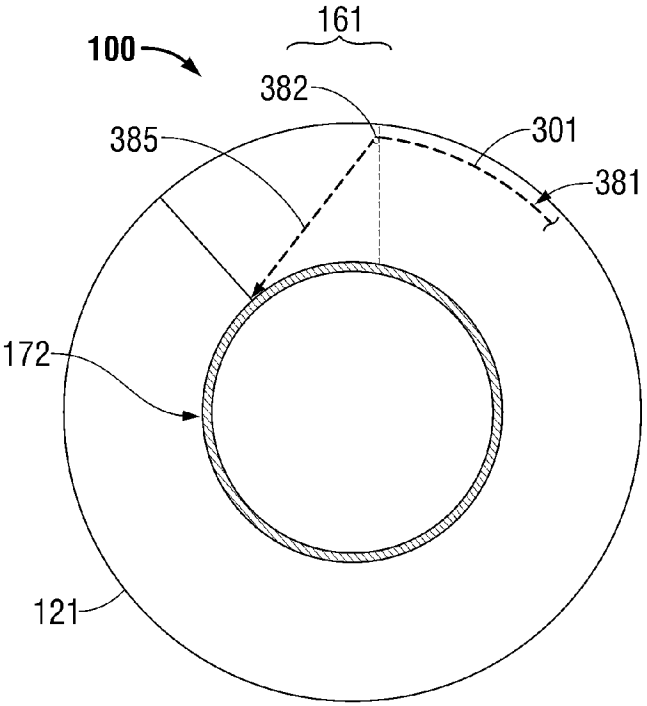
Figure 3D:
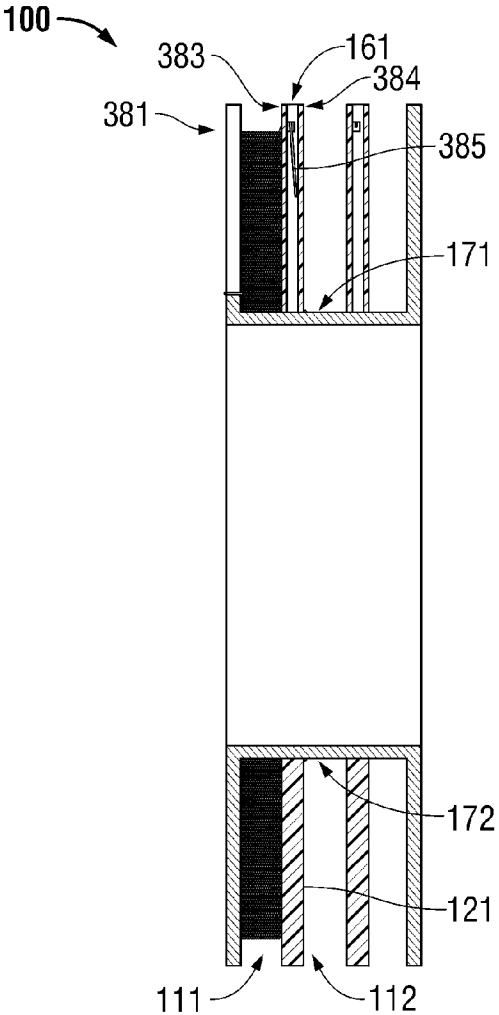

Turning now to cross-sectional views of FIGS. 3C and 3D, descent of wire 301 through channel 161 is illustrated. For example, in FIG. 3C, the illustrated cross-section (3C) through the tapered, laterally-overlapping opposing wall portions 383 and 384 of insulating barrier 121 that define channel 161 depicts a portion 385 of wire 301 descending therethrough from the uppermost layer 381 wound about first winding section 111 toward winding surface 172. FIG. 3D likewise depicts (though through an orthogonal cross-section 3D) a descending portion 385 of wire 301 along its path from a radial alignment at the uppermost layer 381 wound about the first winding section toward a radial alignment corresponding to winding surface 172 of the second winding section. As before, descent is through channel 161 defined by laterally-overlapping opposing wall portions of insulating barrier 121. Wire retainer 382 is illustrated at a position corresponding to the radial alignment of uppermost layer 381, thereby substantially preventing slippage of wire 301 down the face of insulating barrier 121 exposed to the first winding section.

In general, circumferential extent of channel 161 should be sufficient to insulate and isolate a descending portion of wire 301 through at least a substantial entirety of its descent. In the illustration of FIG. 3D, circumferential extent of channel 161 (and its defining wall portions) is sufficient to insulate and isolate the descending portion 385 of wire 301 from both first winding section 111 and second winding section 112 throughout the entirety of its descent. In alternative embodiments, circumferential extent of such a channel may be increased or decreased in accord with design goals.

Note that, although multi-sectional bobbin 100 has been illustrated primarily with regard to formation of a single multi-sectional coil, the design of multi-sectional bobbin 100 is also suitable for receiving certain concentrically wound but electrically isolated coils. For example, as will be apparent from the views of FIGS. 3B and 3C, wire retainer 382 need not span the gap between opposing wall portions 382 and 383. Indeed, in at least some embodiments, the unspanned portion of that gap can be exploited to allow a primary, low turn count, winding through each of the winding of the winding sections, whereupon the closely-laterally-packed, layer-upon-layer winding through first, then second, then third winding sections (which is detailed herein) may overlay a concentrically formed primary coil. In such embodiments, the primary coil may be formed directly on winding surfaces 171, 172 and 173, overlaid with an insulative material such as the aforementioned Kapton® tape, and then the closely-laterally-packed, layer-upon-layer winding through first, then second, then third winding sections may be wound over the insulative material in essentially the manner detailed herein with respect to single coil embodiments. Based on the description herein, persons of ordinary skill in the art will appreciate a wide variety of coil and core configurations that facilitate induction of currents in the described multi-sectional coil.

Figure 4A:
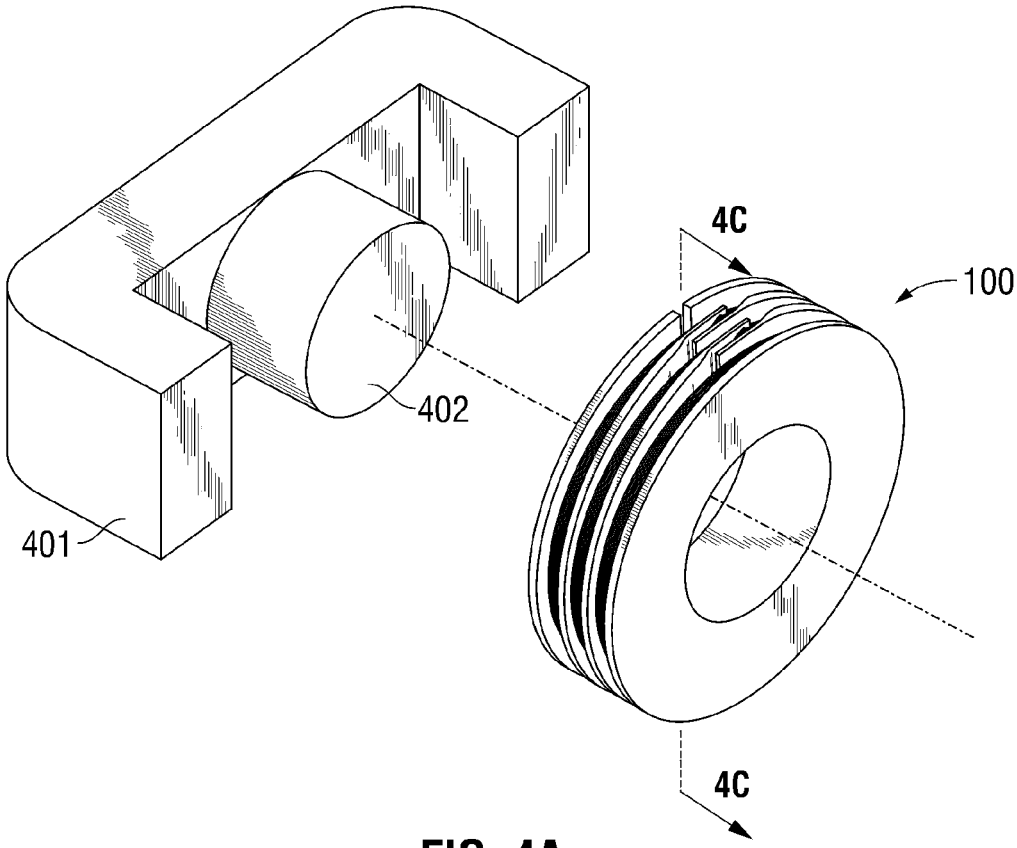
FIGS. 4A and 4B are perspective views of a fully-wound multi-sectional bobbin in accord with some embodiments of the present invention, wherein the fully-wound multi-sectional bobbin is aligned (FIG. 4A) and then operatively combined (FIG. 4B) with an illustrative magnetic core.
Figure 4B:
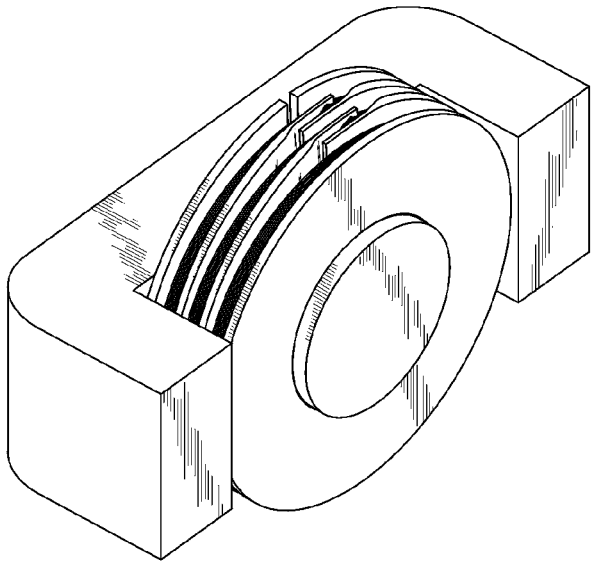
Figure 4D:
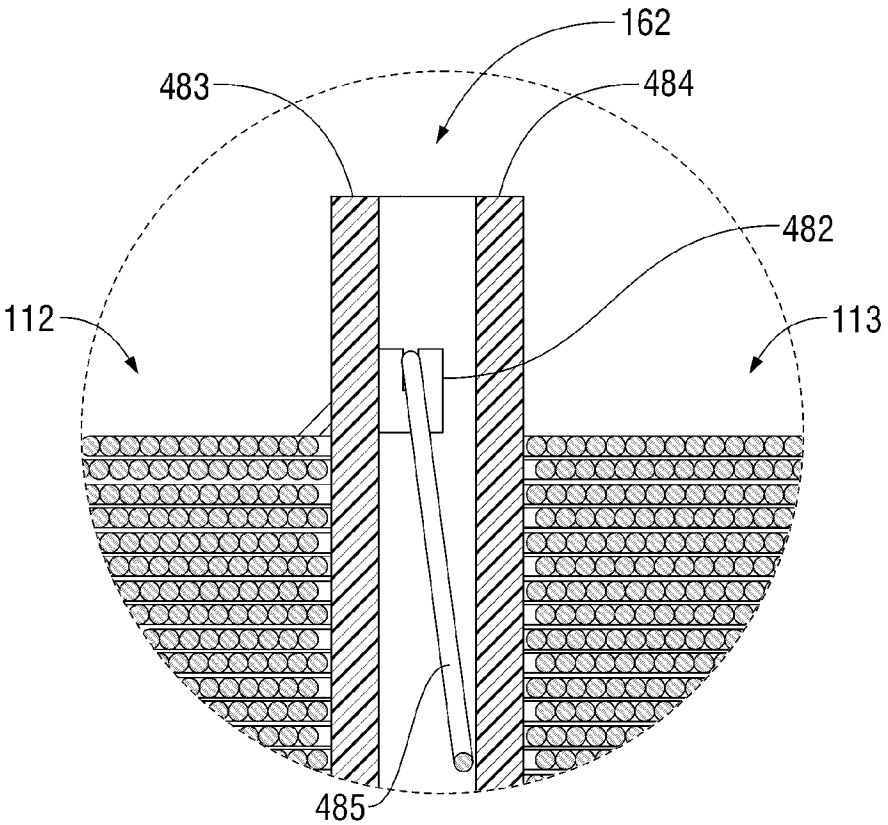
FIG. 4D illustrates a portion of FIG. 4C in an exploded view.

FIGS. 4A and 4B are perspective views of a fully-wound instance of multi-sectional bobbin 100 in accord with some embodiments of the present invention, wherein the fully-wound multi-sectional bobbin is aligned (FIG. 4A) and then operatively combined (FIG. 4B) with an illustrative magnetic core. Although persons of ordinary skill in the art will appreciate, based on the description herein, any of a variety of alternative core configurations, the illustrations of FIGS. 4A and 4B depict a modified "E" core 401 with round central leg 402.

Figure 4C:
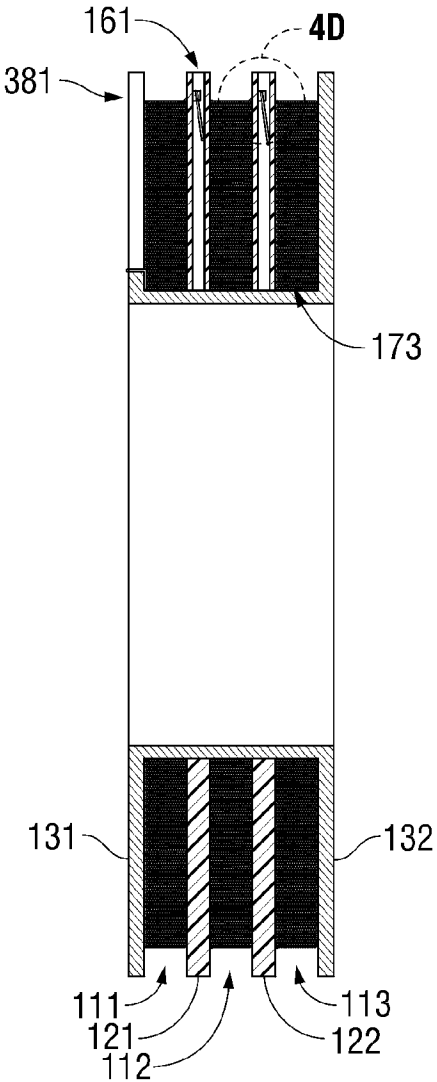
FIG. 4C is a cross-sectional view of the fully-wound multi-sectional bobbin.

FIG. 4C is a cross-sectional view (along cross-section 4C) of the fully-wound multi-sectional bobbin and includes features detailed in the description of various of the preceding figures and views. Expanded detail for channel 162 illustrates the cross-section through tapered, laterally-overlapping opposing wall portions 483 and 484 of insulating barrier 122 that define channel 162 therethrough from first winding section 111 to second winding section 112. More specifically, the expanded detail of FIG. 4C depicts a portion 485 of a wire descending through channel 162 from the uppermost layer 381 wound about second winding section 112 toward winding surface 173 of the third winding section 113. As before, descent is though a channel (here, channel 162) defined by laterally-overlapping opposing wall portions (here, wall portions 483 and 484 of insulating barrier 122). As before, wire retainer 482 is illustrated at a position corresponding to the radial alignment of uppermost layer 381, thereby substantially preventing slippage of the wire down the face of insulating barrier 122 exposed to the second winding section 112.

Figure 5:
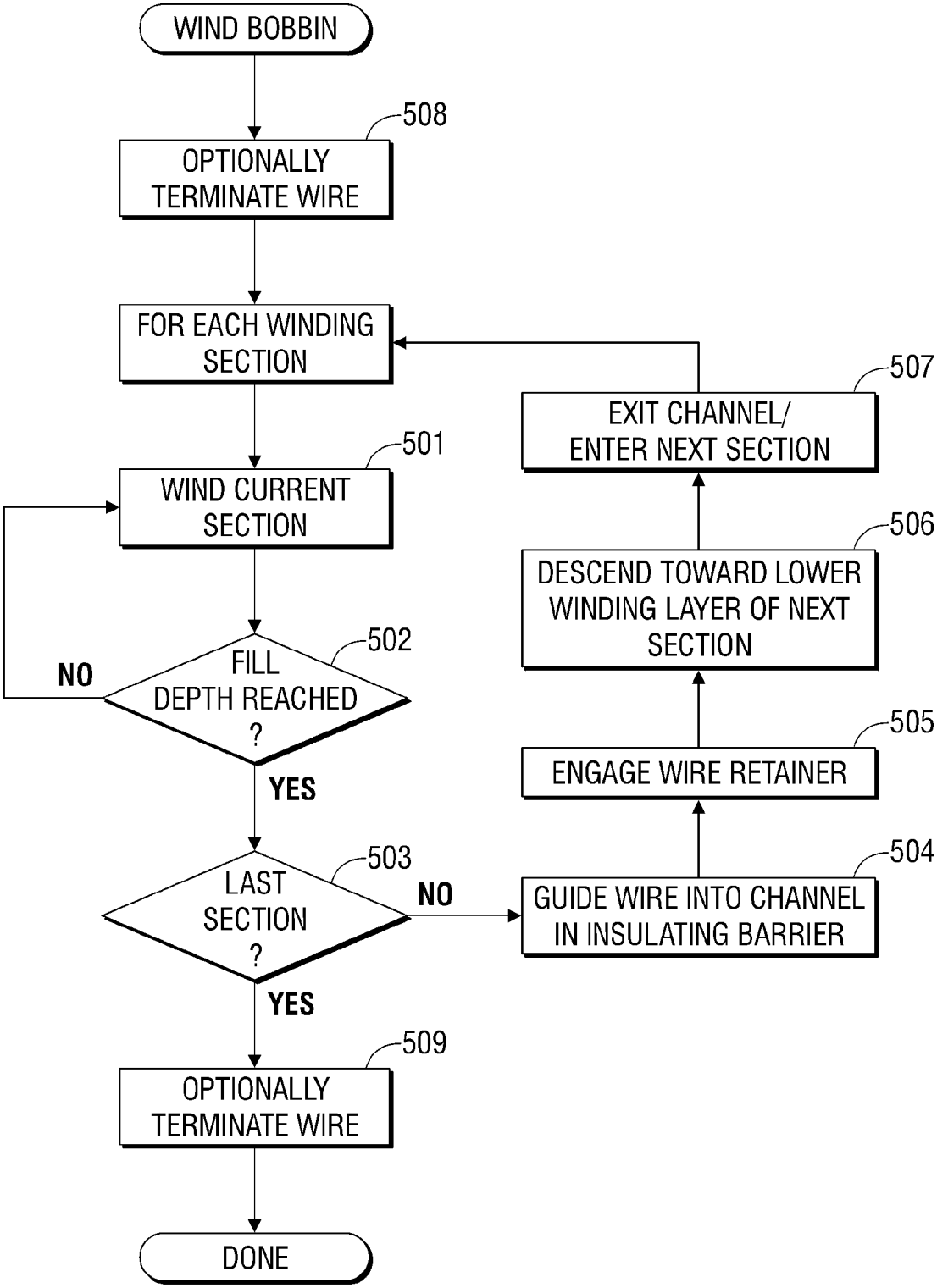
FIG. 5 is a flow chart depicting a sequence of steps for winding successive sections of some multi-sectional bobbins in accord with the present invention.

Finally, FIG. 5 is a flow chart depicting a sequence of steps for winding successive sections of some multi-sectional bobbins in accord with the present invention. For each successive current section, the method winds (501) the current section to a desired fill depth (see predicate 502). As previously explained, in some embodiments, winding from a lower winding level of the current winding section to the uppermost layer thereof is generally laid down in a closely-laterally-packed, layer-at-a-time manner in accord with inductive coupling goals of a secondary coil configuration for a step-up high-voltage transformer. Other embodiments may adopt a different winding strategy or adapt that described herein. Typically, winding includes rotating the described multi-sectional bobbin about its rotational axis while guiding the wire laterally back and forth to achieve the layered fill of the current winding section to desired fill depth.

Upon reaching the desired fill depth, unless the current winding section is the last (see predicate 503), the method continues with steps (e.g., 504, 505, 506, 507) to transit the previously-described channel formed between laterally-overlapping opposing wall portions of the insulating barrier that separates the current winding section from the next. In particular, the illustrated method initiates the path of the wire toward the next section by, in coordination with rotation of the bobbin, guiding (504) the wire into the aforementioned channel and engaging (505) the wire upon a wire retainer in such manner that the wire retainer prevents slippage of the retained wire downward along a sidewall of the insulating barrier that faces the completed prior winding section. From there, even slight tension in the wire in correspondence with rotation of the bobbin causes the wire to descend (506) toward the lower winding layer of the next section, whereupon the lateral travel guides (507) the wire through the channel exit into the next winding section, where winding (501) continues. The illustrated method iterates until the fill depth is reached (502) for the last section (503).

As previously described, in some embodiments, it can be desirable to provide terminations. In such cases, the method may include optional steps to terminate opposing ends (i.e., either or both of terminating steps 508, 509) of the about to be wound (termination 508) and thereafter completely wound (termination 509) wire. Of course other suitable sequencings of the termination steps, including as post processing, may be appropriate or desirable. Methods of manufacture in accord with some embodiments of the present invention may employ any suitable sequencing.

Other Embodiments

While designs and implementations of the multi-sectional bobbins illustrated herein, together with techniques and methods of manufacture therefor, have been described with reference to exemplary embodiments, it will be understood by those skilled in the art that various changes may be made and equivalents may be substituted for elements thereof without departing from the scope of the appended claims. In addition, many modifications may be made to adapt a particular configuration, situation or material to the teachings without departing from the essential scope thereof. Therefore, the particular embodiments, implementations and techniques disclosed herein, some of which indicate the best mode contemplated for carrying out these designs, implementations and techniques, are not intended to limit the scope of the appended claims.

What is claimed is:

1. A bobbin suitable for winding wire and thereby defining an inductor, the bobbin comprising:

first and second winding sections separated from one another with an insulating barrier;

the insulating barrier defining a channel suitable to accommodate a portion of the wire that transits from the first winding section to the second, the channel defined by opposing walls configured to separate the transiting portion of the wire from both first and second winding sections through a substantial entirety of its descent from an upper winding layer in the first winding section to a lower winding layer in the second winding section.

2. The bobbin of claim 1, further comprising:

proximate an entrance to the channel from the first winding section, a wire retainer from which the wire, when wound, descends toward the second winding section.

3. The bobbin of claim 2, wherein the wire retainer includes a pin, flange or other protuberance suitable for retaining the wire.

4. The bobbin of claim 3, wherein the wire retainer is positioned at a height off a winding surface of the first winding section that approximates a design height for the upper winding layer when wound therein.

5. The bobbin of claim 3, wherein the wire retainer is positioned at a height off a winding surface selected to prevent slippage of the retained wire downward along a first winding section-facing surface of the insulating barrier and proximate to lower winding layers when wound therein.

6. The bobbin of claim 1, further comprising:

a ramp or ledge defined within the channel and descending from a height at or near the channel entrance whereby the transiting wire is supported at the channel entrance at a height that prevents slippage of the wire downward along a first winding section-facing surface of the insulating barrier.

7. The bobbin of claim 1, wherein the insulating barrier circumferentially spans winding surfaces of the bobbin and overlapping extents thereof at least partially define the channel.

8. The bobbin of claim 7, wherein the circumferential extent of the insulating barrier is sufficient to insulate and isolate the descending portion of the wire from the first winding section and the second winding section throughout the substantial entirety of its descent.

9. The bobbin of claim 1, further comprising:

the wire, wherein the wire is wound about the first section, descends through the channel from an upper winding layer wound about the first section to a lower winding layer wound about the second section, and is wound about the second section.

10. The bobbin of claim 1, further comprising:

at least a third winding section, wherein the second and third winding sections are separated from one another with a second insulating barrier.

11. The bobbin of claim 10, wherein the second insulating barrier defines a second channel suitable to accommodate a portion of the wire that transits from the second winding section to the third, the second channel defined by opposing walls thereof configured to separate the transiting portion of the wire from both first and second winding sections through a substantial entirety of its descent from an upper winding layer in the second winding section to a lower winding layer in the third winding section.

12. A method of making a multi-sectional transformer coil, the method comprising:

providing a bobbin having first and second winding sections separated from one another with an insulating barrier;

winding a first wire about the first section of the bobbin;

guiding the first wire through a channel in the insulating barrier and thereby descending from an upper winding layer in the first winding section to a lower winding layer in the second winding section, the channel defined by opposing walls configured to separate the descending portion of the first wire from both first and second winding sections through a substantial entirety of its descent from the upper winding layer in the first winding section to the lower winding layer in the second winding section; and winding the first wire about the second section of the bobbin.

13. The method of claim 12, further comprising:

prior to the providing, forming the bobbin with the channel defined in the insulating barrier between first and second winding sections.

14. The method of claim 12, further comprising:

forming proximate an entrance to the channel from the first winding section, a wire retainer from which the first wire, when wound, descends toward the second winding section; and guiding the first wire to engage the wire retainer.

15. The method of claim 12, further comprising:

prior to said winding of the first wire about the first and second sections of the bobbin, winding second wire about the bobbin to define a low turn count, primary coil wound through each of the winding sections;

overlaying the low turn count, primary coil with insulative material;

wherein the winding of the first wire defines a closely-laterally-packed, layer-upon-layer winding through first and third winding sections overlaying the insulative material and the primary coil concentrically formed thereunder.

16. The method of claim 12, further comprising:

magnetically coupling with an adjacent coil with the coil defined by the first wire wound about the first and second winding sections.

17. A transformer comprising:

magnetically coupled first and second coils, wherein the second coil is wound about a multi-sectional bobbin including first and second winding sections separated from one another with an insulating barrier that defines a channel to accommodate a portion of the wire that transits from the first winding section to the second winding section, the channel defined by opposing walls configured to separate the transiting portion of the wire from both first and second winding sections through a substantial entirety of its descent from an upper winding layer in the first winding section to a lower winding layer in the second winding section.

18. The transformer of claim 12, wherein the first and second coils constitute primary and secondary coils, respectively, in a step-up configuration.

* * * * *